US010626828B2

(12) United States Patent
Chu et al.

(10) Patent No.: US 10,626,828 B2
(45) Date of Patent: Apr. 21, 2020

(54) EXHAUST GAS CONTROL VALVE OF ENGINE

(71) Applicants: HYUNDAI MOTOR COMPANY, Seoul (KR); KIA MOTORS CORPORATION, Seoul (KR)

(72) Inventors: Dong Ho Chu, Yongin-si (KR); Hyeon Ho Kim, Yongin-si (KR); Hyuk Im, Suwon-si (KR); Dong Hee Han, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 33 days.

(21) Appl. No.: 16/118,042

(22) Filed: Aug. 30, 2018

(65) Prior Publication Data

US 2019/0338734 A1 Nov. 7, 2019

(30) Foreign Application Priority Data

May 4, 2018 (KR) ..... 10-2018-0051749

(51) Int. Cl.

| | |
|---|---|
| ***F02M 26/00*** | (2016.01) |
| ***F02M 26/70*** | (2016.01) |
| ***F01N 3/20*** | (2006.01) |
| ***F02M 26/35*** | (2016.01) |
| ***F02M 26/16*** | (2016.01) |

(Continued)

(52) U.S. Cl.

CPC ..... *F02M 26/70* (2016.02); *F01N 3/2006* (2013.01); *F02D 41/0077* (2013.01); *F02M 26/15* (2016.02); *F02M 26/16* (2016.02); *F02M 26/35* (2016.02)

(58) Field of Classification Search

CPC ..... F02M 26/70; F02M 26/15; F02M 26/16; F02M 26/35; F02D 41/007; F01N 3/2006

See application file for complete search history.

(56) References Cited

U.S. PATENT DOCUMENTS 3,521,659 A * 7/1970 Seger ..... F16K 15/033 137/112
4,171,689 A * 10/1979 Eheim ..... F02M 26/63 123/568.18

(Continued)

FOREIGN PATENT DOCUMENTS

JP 3367574 B2 1/2003
JP 3835856 B2 10/2006

(Continued)

*Primary Examiner* — Phutthiwat Wongwian
*Assistant Examiner* — Sherman D Manley
(74) *Attorney, Agent, or Firm* — Morgan, Lewis & Bockius LLP

(57) ABSTRACT

An exhaust gas control valve of an engine, which includes a plurality of engine exhausts ports, a catalytic converter, a plurality of combustion chambers, and an Exhaust Gas Recirculation (EGR) line, includes: a valve body having an inflow port communicating with only some of the plurality of engine exhaust ports, an exhaust port communicating with the catalytic converter and a recirculation port communicating with the EGR line; and a valve flap assembly rotatably installed at the valve body to block one of the exhaust port and the recirculation port while opening the other of the exhaust port and the recirculation port.

5 Claims, 6 Drawing Sheets

(51) Int. Cl.
*F02D 41/00* (2006.01)
*F02M 26/15* (2016.01)

(56) References Cited

U.S. PATENT DOCUMENTS 5,908,047 A * 6/1999 Nakamura ..... F01N 3/027 137/875
6,286,306 B1 * 9/2001 Takakura ..... B01D 53/9454 60/286
6,286,489 B1 * 9/2001 Bailey ..... F02D 41/0047 123/568.11
6,896,000 B2 * 5/2005 Brenner ..... F01N 3/029 137/597
6,955,188 B2 * 10/2005 Heckt ..... F01N 3/031 137/87.01
7,721,541 B2 * 5/2010 Roberts, Jr. ..... F02D 25/00 123/568.11
9,541,206 B2 * 1/2017 Diehl ..... F16K 11/052
9,631,582 B2 * 4/2017 Geckler ..... F02D 41/06
9,709,178 B2 * 7/2017 Dowd ..... F16K 11/0525
2008/0314037 A1 * 12/2008 Neels ..... B01D 53/9431 60/324
2009/0301067 A1 * 12/2009 Dingle ..... F01N 3/021 60/286
2011/0253113 A1 * 10/2011 Roth ..... F02D 41/008 123/568.12
2012/0260894 A1 * 10/2012 Hayman ..... F02B 47/08 123/559.1
2013/0199494 A1 * 8/2013 Rabhi ..... F02B 17/005 123/295
2015/0240957 A1 * 8/2015 Elsaesser ..... F02M 26/26 60/324
2016/0017783 A1 1/2016 Keating
2016/0040589 A1 * 2/2016 Glugla ..... F02D 41/0077 60/278
2016/0123482 A1 * 5/2016 Morris ..... F01N 5/02 60/320
2017/0002774 A1 * 1/2017 Selway ..... F02M 26/41
2018/0306133 A1 * 10/2018 Lutz ..... F02D 41/0065
2018/0320640 A1 * 11/2018 Racca ..... F02M 26/06
2018/0347433 A1 * 12/2018 Montinaro ..... F01N 3/0814

FOREIGN PATENT DOCUMENTS

JP 2010-229878 A 10/2010
KR 10-0337333 B1 5/2002
KR 10-2007-0076664 A 7/2007
KR 10-2014-0020251 A 2/2014

* cited by examiner

EXHAUST GAS CONTROL VALVE OF ENGINE

CROSS REFERENCE TO RELATED APPLICATION

The present application claims priority of Korean Patent Application No. 10-2018-0051749 filed on May 4, 2018, the entire contents of which is incorporated herein for all purposes by this reference.

TECHNICAL FIELD

The present disclosure relates to a valve which controls the flow of exhaust gas of an engine.

BACKGROUND

An engine performs an exhaust gas recirculation (EGR) which recirculates exhaust gas back to an intake side in order to reduce nitrogen oxide in the exhaust gas, and sufficient EGR gas supply should be available for smooth EGR operation.

Further, during cold starting of the engine, a catalyst of a catalytic converter, which purifies a harmful material in the exhaust gas, should be able to quickly reach a LOT (Light Off Temperature). To this end, the exhaust gas energy should be able to be delivered to the catalyst as much as possible.

The foregoing is intended merely to aid in the understanding of the background of the present disclosure, and is not intended to mean that the present disclosure falls within the purview of the related art that is already known to those skilled in the art.

SUMMARY

The present disclosure has been made keeping in mind the above problems occurring in the related art, and the present disclosure is intended to propose an exhaust gas control valve of an engine that all exhaust gas is supplied to a catalytic converter in the early stage of cold start of the engine so that catalyst activation can be done quickly and in case of driving condition requiring EGR of engine, it is possible to supply sufficient EGR gas to the engine while taking as minimum numbers of parts and space as possible.

An exhaust gas control valve of an engine, which includes a plurality of engine exhausts ports, a catalytic converter, a plurality of combustion chambers, and an Exhaust Gas Recirculation (EGR) line, according to an exemplary embodiment of the present disclosure includes: a valve body having an inflow port communicating with only some of the plurality of the engine exhaust ports, an exhaust port communicating with the catalytic converter and a recirculation port communicating with the EGR line; and a valve flap assembly rotatably installed at the valve body to block one of the exhaust port and the recirculation port while opening the other of the exhaust port and the recirculation port.

The valve flap assembly may include a valve arm rotatably mounted at the valve body for receiving torque from the outside of the valve body; and a first flap and a second flap coupled to both sides of the valve arm to open or close the exhaust port and the recirculation port, respectively.

The first flap and the second flap may be disposed in order to overlay each other with valve arm disposed therebetween; the first flap, the valve arm and the second flap sequentially overlapped may be fixed by a valve pin penetrating therethrough; and a washer spring may be disposed between the first flap and the valve arm and between the second flap and the valve arm.

The first flap and the second flap may form a stepped portion sunk while surrounding the valve pin on the faces towards the exhaust port and recirculation port, respectively; and both ends of the valve pin may be formed to be each deformed by caulking to be located inside the stepped portion to prevent the first flap and the second flap from escaping.

The washer spring may be formed of a slant cross section structure to form a conical shape.

The exhaust port and the recirculation port of the valve body may be obliquely disposed facing each other at both sides around the inflow port; and the valve arm may be rotatably installed between the exhaust port and the recirculation port, so that the state that the first flap seals the exhaust port and the state that the second flap seals the recirculation port can be switched by the rotation of the valve arm.

The inflow port of the valve body may be formed to be communicated with only the exhaust ports of one side among the plurality of exhaust ports communicated respectively to a plurality of combustion chambers disposed in a same line; the exhaust ports connected to the inflow port may be connected with each other only through the valve body without being directly connected to the exhaust manifold where the other exhaust ports are connected with; and the catalytic converter may be installed at the exhaust manifold downstream.

According to the present disclosure, the exhaust gas is all supplied to the catalytic converter at the beginning of the cold start of the engine so that the catalyst is activated quickly, in the driving conditions requiring EGR of the engine, it is possible to supply enough EGR gas to the engine while occupying the minimum number of parts and space as possible, and the harmful substances in the exhaust gas is purified more effectively in the entire operating range including the beginning of the cold start of the engine, thereby responding to various exhaust regulations and protecting the environment.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Figure 1:
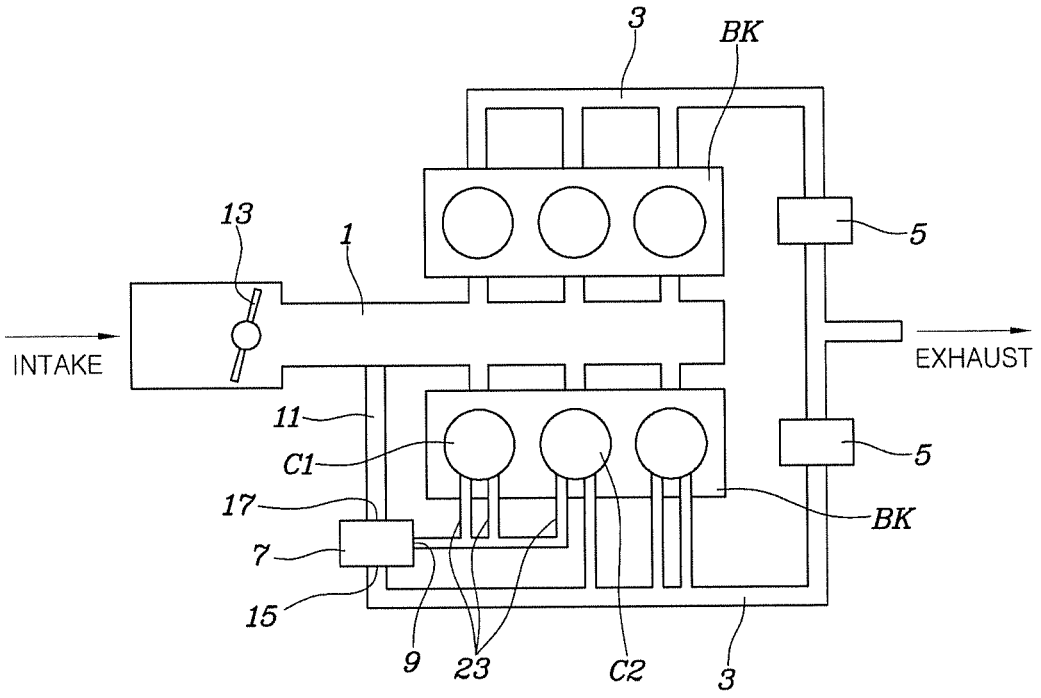
FIG. 1 is a drawing illustrating the configuration of an engine to which the present disclosure can be applied.

Specific structural and functional descriptions of the embodiments of the present disclosure disclosed in this disclosure or application are illustrative only for the purpose of describing the embodiments and the embodiments according to the present disclosure may be implemented in various forms and should not be construed as being limited to embodiments described in this disclosure or application.

The embodiments according to the present disclosure may be variously modified and may have various forms, so that specific embodiments will be illustrated in the drawings and be described in detail in this disclosure or application. It should be understood, however, that it is not intended to limit the embodiments according to the concept of the present disclosure to specific disclosure forms, but it includes all modifications, equivalents, and alternatives falling within the spirit and scope of the present disclosure.

The terms first, second, and/or the like may be used to describe various components, but the components should not be limited by these terms. These terms may be used only for the purpose of distinguishing one component from another component, and, for example, a first component may be referred to as a second element, and similarly, the second component may also be referred to as the first component without departing from the scope of the present disclosure.

When a component is referred to as being "connected," or "coupled" to other component, it may be directly connected or coupled to the other component, but it should be understood that another component may exist between the component and the other component. Contrarily, when a component is referred to as being "directly connected," or "directly coupled" to other component, it should be understood that another component may be absent between the component and the other component. Other expressions describing the relationship between components, that is, "between" and "immediately between," or "adjacent to" and "directly adjacent to" should also be construed as described above.

Terms used herein is used only for the purpose of describing specific embodiments, and are not intended to limit the present disclosure. Unless the context clearly dictates otherwise, the singular form includes the plural form. In this description, the terms "comprising," "having," or the like are used to specify that a feature, a number, a step, an operation, a component, an element, or a combination thereof described herein exists, and they do not preclude the presence or addition of one or more other features, numbers, steps, operations, components, elements, or combinations thereof.

Unless defined otherwise, all terms including technical or scientific terms used herein have the same meaning as commonly understood by those skilled in the art to which the present disclosure pertains. General terms that are defined in a dictionary shall be construed to have meanings that are consistent in the context of the relevant art, and will not be interpreted as having an idealistic or excessively formalistic meaning unless clearly defined in the present disclosure.

Hereinafter, exemplary embodiments of the present disclosure will be described in detail with reference to the accompanying drawings. Like reference numerals denote like members throughout the drawings.

FIG. 1 is a drawing illustrating the configuration of an engine to which the present disclosure can be applied and shows an example of a V-6 engine.

An intake manifold 1 may be provided between two banks BK in which three combustion chambers are disposed, an exhaust manifolds 3 may be located outside the two banks BK, and a catalytic converter 5 may be installed in each of the exhaust manifold 3.

Figure 2:
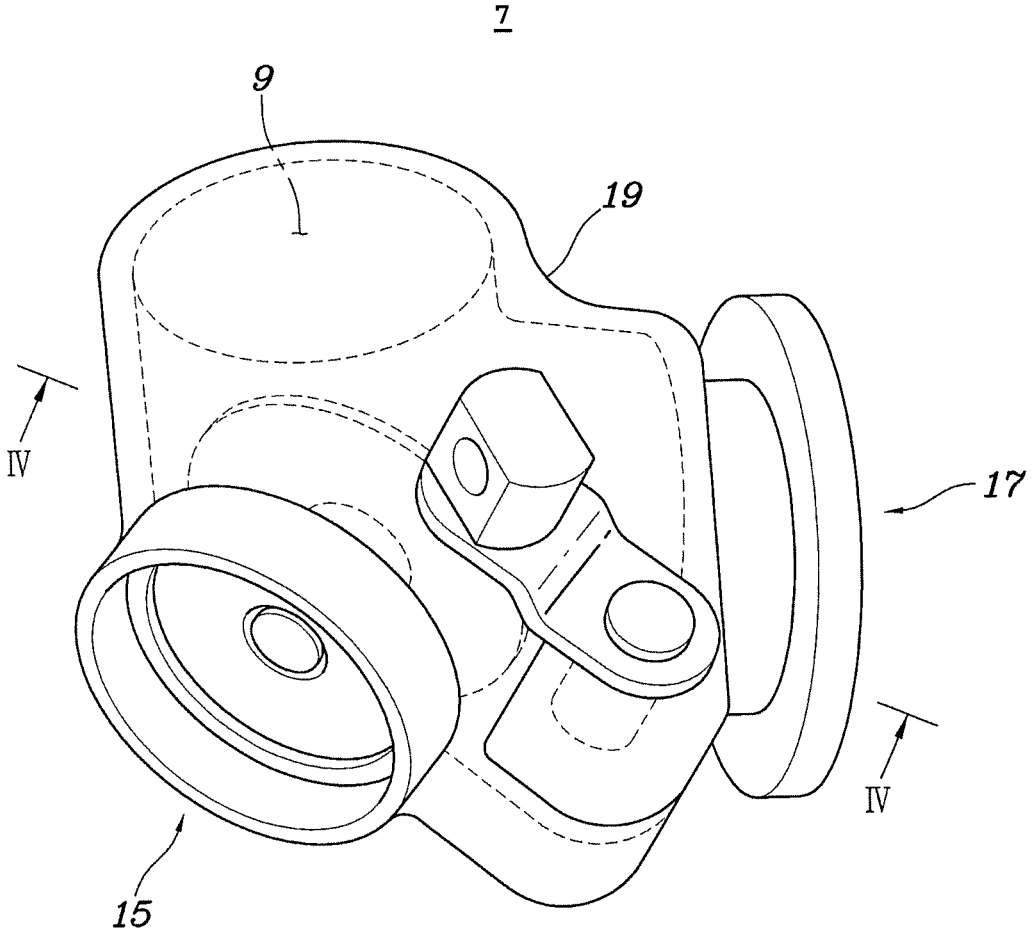
FIG. 2 is a drawing showing the configuration of an exhaust control valve of an engine according to the present disclosure.
Figure 3:
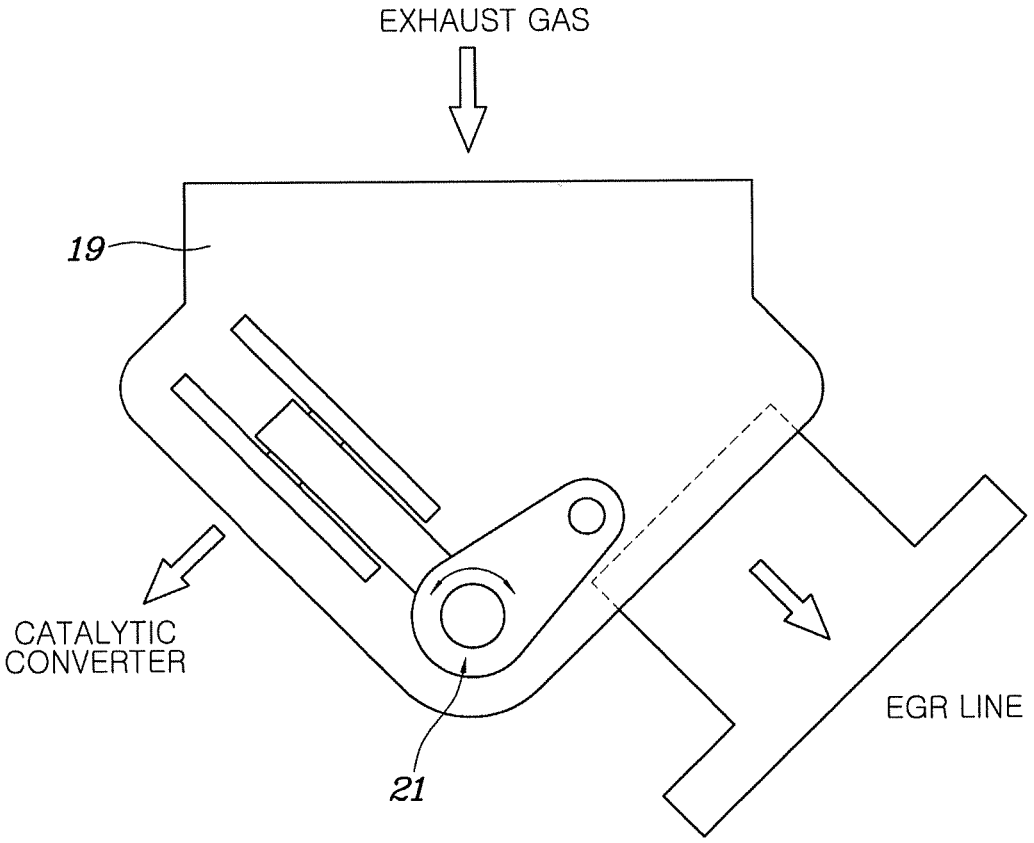
FIG. 3 is a drawing explaining the operation of the exhaust control valve shown in FIG. 2.
Figure 4:
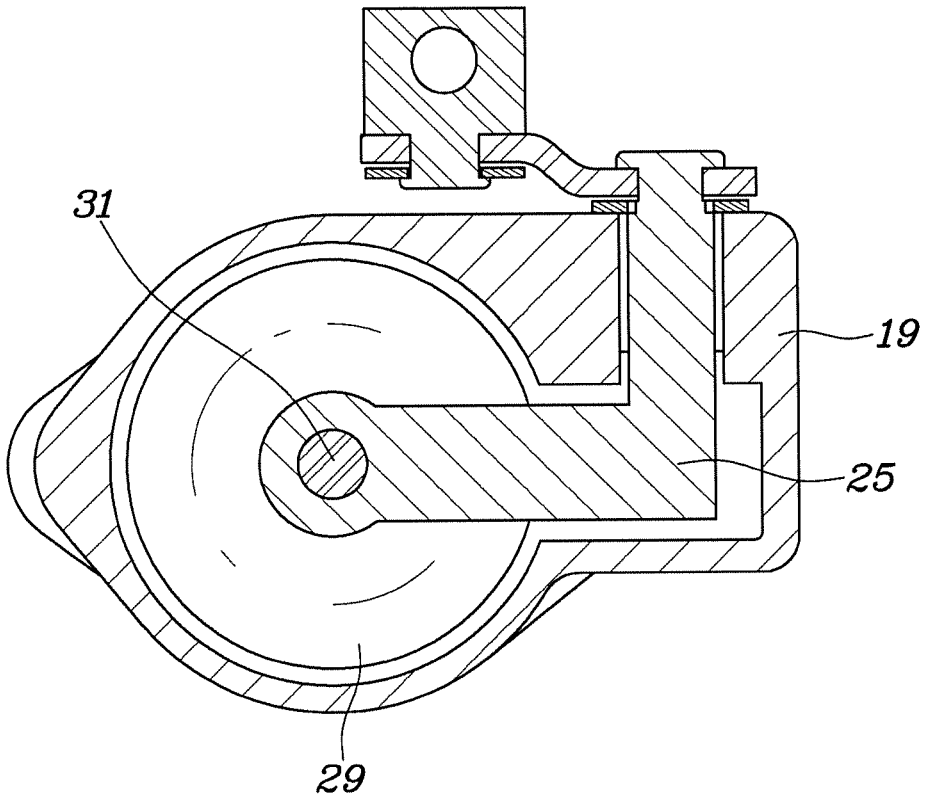
FIG. 4 is a cross sectional view along the IV-IV line of FIG. 2.
Figure 5:
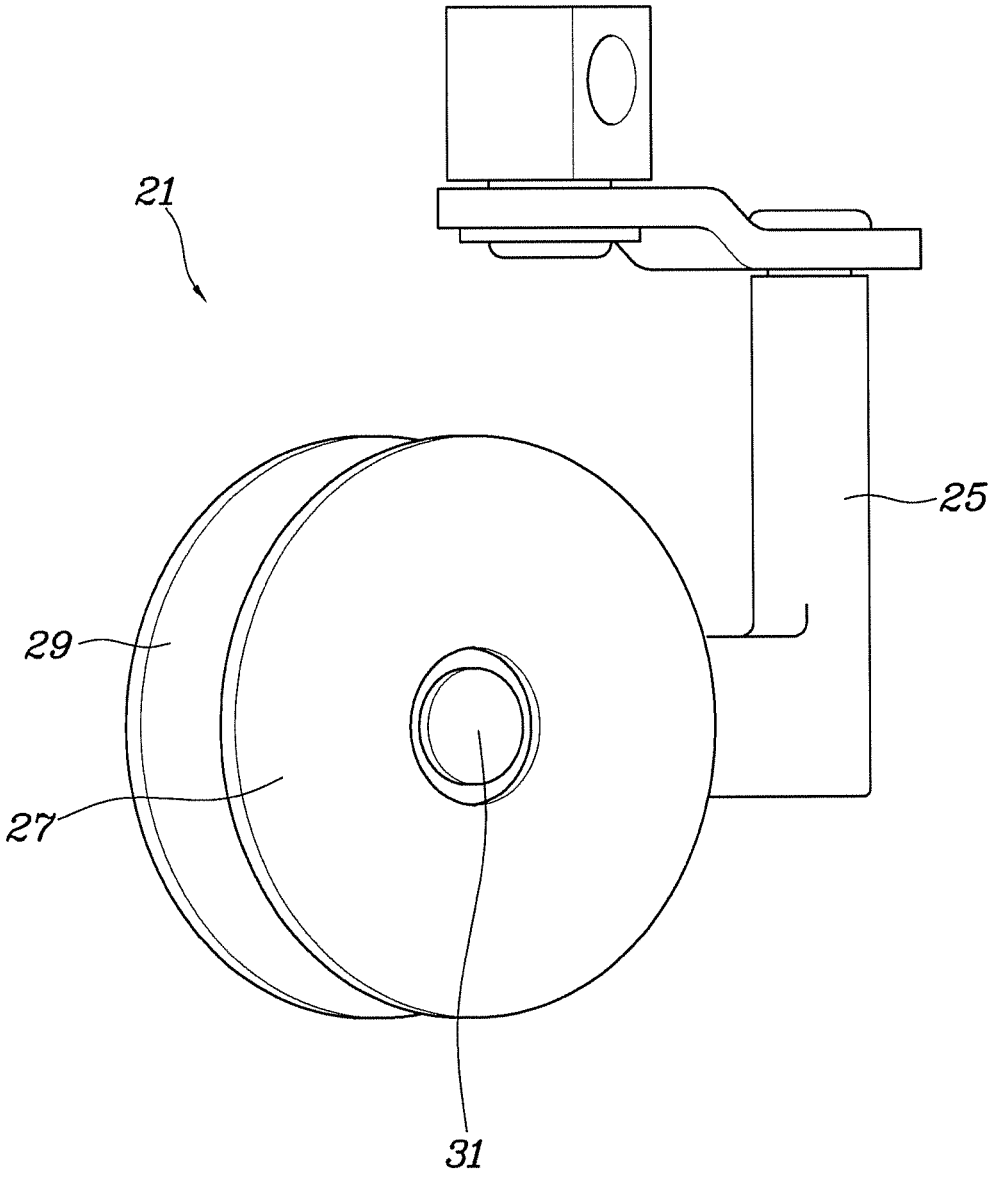
FIG. 5 is a drawing showing a valve flap assembly shown in FIG. 2.

Some of a plurality of exhaust ports provided in the lower bank of the engine may be only communicated to an inflow port 9 (see FIG. 2) of an exhaust control valve 7 which will be described later and the exhaust control valve 7 may be connected to the intake manifold 1 via an EGR line 11 so that an EGR gas can be mixed with the air that is flowed into the intake manifold 1 through a throttle valve 13.

The EGR line 11 may be equipped with an EGR valve for controlling the flow rate of the EGR gas and an EGR cooler for cooling the EGR gas.

FIG. 1 is an example of an engine equipped with two banks BK such as V-6 engine, but the exhaust control valve 7 of the present disclosure to be described later can be used for all engines in which a plurality of combustion chambers constitute one engine, such as an I-4 engine in which four combustion chambers are arranged in a line.

Referring to FIGS. 2 to 6, the exhaust control valve 7 of the engine according to the present disclosure may include a valve body 19 having the inflow port 9 communicated with only some of the plurality of the exhaust ports provided in the engine, an exhaust port 15 communicated with the catalytic converter 5 and a recirculation port 17 communicated with the EGR line 11; and a valve flap assembly 21 rotatably installed at the valve body 19 in order to switch the state that one of the exhaust port 15 and the recirculation port 17 is blocked and the other is opened.

That is, the valve body 19 may be configured to receive the exhaust gas through the inflow port 9 communicated with an exhaust port 23 of the engine and switch the state that supplies the exhaust gas to the catalytic converter 5 through the exhaust port 15 or supplies the exhaust gas to the intake manifold 1 through the EGR line 11 according to the operation condition of the valve flap assembly 21.

The valve flap assembly 21 may be configured to include a valve arm 25 rotatably mounted at the valve body 19 for receiving torque from the outside of the valve body 19; and a first flap 27 and a second flap 29 coupled to both sides of the valve arm 25 to open or close the exhaust port 15 and the recirculation port 17, respectively.

The first flap 27 and the second flap 29 may be disposed so as to overlay each other with valve arm 25 disposed therebetween; the first flap 27, the valve arm 25 and the second flap 29 sequentially overlapped may be fixed by a valve pin 31 penetrating therethrough; and a washer spring 33 may be interposed between the first flap 27 and the valve arm 25 and between the second flap 29 and the valve arm 25, respectively.

Thus, the first flap 27 and the second flap 29 can be slightly altered in position or angle relative to the valve arm 25, respectively, and also elastically supported by the washer spring 33, so that the first flap 27 and the second flap 29 are tightly contact with the exhaust port 15 and recirculation port 17 by the rotation of the valve arm 25, respectively, thereby almost preventing leakage of the exhaust gas from the closed port with closing the exhaust port 15 or recirculation port 17.

The first flap 27 and the second flap 29 may form a stepped portion 35 sunk while surrounding the valve pin 31 on the faces towards the exhaust port 15 and recirculation port 17, respectively, and both ends of the valve pin 31 may be formed to be each deformed by caulking to be located inside the stepped portion 35 to prevent the first flap 27 and the second flap 29 from escaping.

This is because if the first flap 27 and the second flap 29 are fastened to the valve pin 31 by for example welding, the welding heat may damage the washer spring 33.

Figure 6:
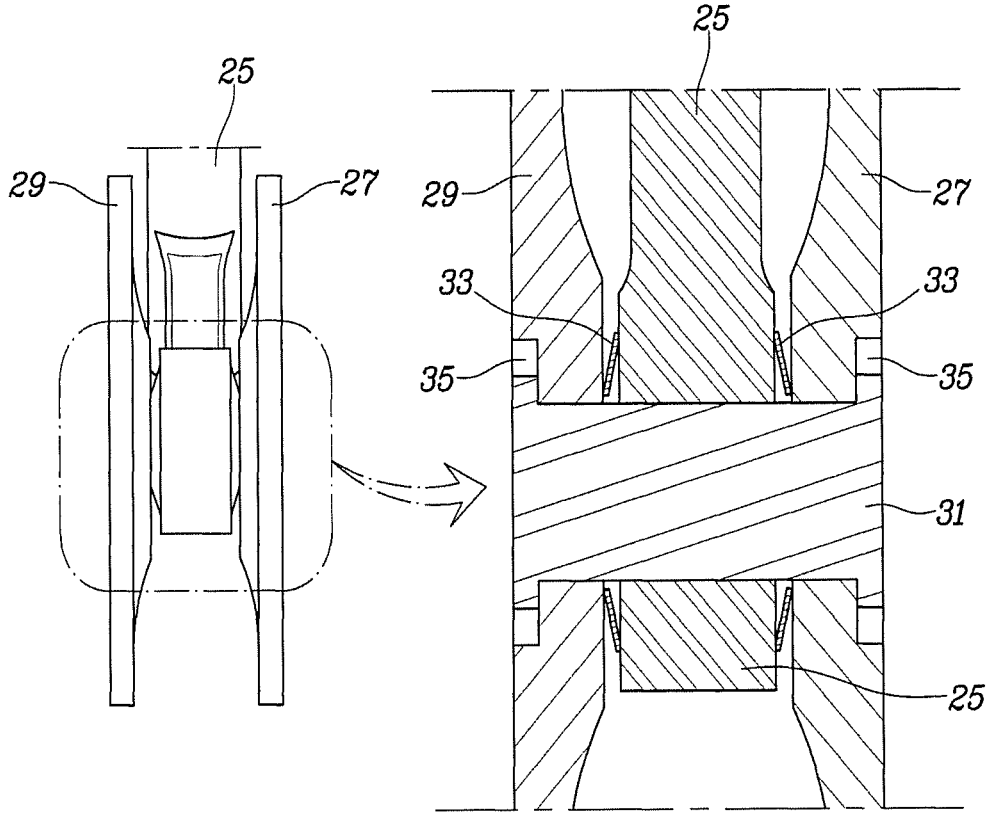
FIG. 6 is a drawing explaining the coupling structure of a valve arm and the first flap and the second flap.

The washer spring 33, as shown in FIG. 6, may be formed of a slant cross section structure to form a conical shape and apply an elastic force to the first flap 27 and the second flap 29 so that it is possible to mitigate noise and impact and ensure tight sealing properties when closing the exhaust port 15 or recirculation port 17.

The exhaust port 15 and the recirculation port 17 of the valve body 19 may be obliquely disposed facing each other at both sides around the inflow port 9, and the valve arm 25 may be rotatably installed between the exhaust port 15 and the recirculation port 17, so that the state that the first flap 27 seals the exhaust port 15 and the state that the second flap 29 seals the recirculation port 17 can be switched by the rotation of the valve arm 25.

On the other hand, the valve arm 25 may be connected with an external actuator, and when the actuator is activated by the control of engine controller, the valve arm 25 is rotated so that the first flap 27 and the second flap 29 can adjust the open or close states of the exhaust port 15 and the recirculation port 17.

The inflow port 9 of the valve body 19 may be communicated to only the exhaust ports of one side among the plurality of exhaust ports communicated respectively to a plurality of combustion chambers disposed in a same line, the exhaust ports connected to the inflow port 9 may be connected with each other only through the valve body 19 without being directly connected to the exhaust manifold 3 where the other exhaust ports are connected with, and the catalytic converter 5 may be installed at the exhaust manifold 3 downstream.

FIG. 1 shows that the inflow port 9 of the valve body 19 is communicated to two exhaust ports connected to the first combustion chamber C1 and one exhaust port of the second combustion chamber C2, but it may be configured to be connected to only two exhaust ports connected to the first combustion chamber C1, and may allow more exhaust ports to be connected thereto.

During the cold start of the engine, in order to rapidly raise the temperature of the catalytic converter 5, the second flap 29 seals the recirculation port 17 so that the exhaust gas flowed into the valve body 19 through the inflow port 9 together with the exhaust gas discharged from the other combustion chambers are all supplied to the catalytic converter 5, and thus the exhaust control valve 7 can assist the temperature rise of the catalytic converter 5.

Thereafter, when the engine is in operation requiring EGR gas, the first flap 27 switches to the state sealing the exhaust port 15, so that the exhaust gas flowed into the inflow port 9 is supplied to the intake manifold 1 as EGR gas.

Thus, if it is configured that all the amount of the exhaust gas of the exhaust ports 23 communicated to the inflow port 9 among the exhaust ports of the engine can be supplied only as the EGR gas, a relatively large amount of EGR gas can be secured with a simple configuration, so that it is possible to obtain a sufficient amount of EGR gas required by the engine.

That is, since the EGR line 11 should be formed in both banks BK, respectively, in order to secure enough EGR gas in the conventional V-6 engine shown in FIG. 1, which needs by two parts to implement EGR such as EGR line 11, EGR valve, EGR cooler, etc., so that cost and volume are greatly increased. In the present disclosure, however, by applying the exhaust control valve 7 to the existing EGR line 11, it is possible to supply all the exhaust gas generated from some combustion chambers only as EGR gas, thereby securing sufficient EGR gas with only a simple configuration.

Therefore, the present disclosure has a technological effect that allows a rapid increase in the temperature of the catalytic converter 5 during the cold start of the engine while allowing a sufficient amount of EGR gas to be secured with a relatively simple and compact configuration.

Although specific embodiments of the present disclosure has been described and illustrated, those skilled in the art will appreciate that various alternations and modifications are possible without departing from the technical spirit of the present disclosure as disclosed in the appended claims.

What is claimed is:

1. An exhaust gas control valve of an engine, which includes a plurality of engine exhausts ports, a catalytic converter, a plurality of combustion chambers, and an Exhaust Gas Recirculation (EGR) line, the exhaust gas control valve comprising:

a valve body having:

an inflow port communicating with only some of the plurality of engine exhaust ports;

an exhaust port communicating with the catalytic converter; and a recirculation port communicating with the EGR line; and a valve flap assembly rotatably installed at the valve body to block one of the exhaust port and the recirculation port while opening the other of the exhaust port and the recirculation port, wherein the valve flap assembly comprises:

a valve arm rotatably mounted at the valve body for receiving torque from outside of the valve body; and a first flap and a second flap coupled to both sides of the valve arm to open or close the exhaust port and the recirculation port, respectively, wherein the first flap and the second flap are disposed and overlay each other with the valve arm which is arranged between the first flap and the second flap;

wherein the first flap, the valve arm, and the second flap are sequentially overlapped and fixed by a valve pin which sequentially penetrates through the first flap, the valve arm, and the second flap; and wherein a washer spring is arranged between the first flap and the valve arm and between the second flap and the valve arm.

2. The exhaust gas control valve of claim 1, wherein the first flap and the second flap are spaced apart from each other and each of the first flap and the second flap has a stepped portion in a center so that the valve pin extending through the stepped portion of ach of the first flap and the second flap on faces towards the exhaust port and recirculation port, respectively, and wherein both ends of the valve pin are disposed inside the stepped portion to prevent the first flap and the second flap from escaping.

3. The exhaust gas control valve of claim 1, wherein the washer spring has a slant cross section structure having a conical shape.

4. The exhaust gas control valve of claim 1, wherein the exhaust port and the recirculation port of the valve body obliquely face each other at respective sides of the inflow port, and wherein the valve arm is rotatably arranged between the exhaust port and the recirculation port, so that the valve arm switches a state that the first flap seals the exhaust port to a state that the second flap seals the recirculation port when the valve arm rotates.

5. The exhaust gas control valve of claim 1, wherein the inflow port of the valve body communicates with only some of the engine exhaust ports of combustion chambers which are disposed in a same line, wherein the engine exhaust ports, which are connected to the inflow port, are connected with each other through the valve body to be indirectly connected to the exhaust manifold with which the remaining engine exhaust ports are connected, and wherein the catalytic converter is disposed at an exhaust manifold downstream.

* * * * *